US009809352B1

(12) United States Patent
Dalton

(10) Patent No.: US 9,809,352 B1
(45) Date of Patent: Nov. 7, 2017

(54) PRODUCT PACKAGING WITH EXTERNAL PRODUCT INDICATOR

(71) Applicant: LJWC LLC, Riverside, CT (US)

(72) Inventor: John Dalton, Riverside, CT (US)

(73) Assignee: LJWC LLC, Riverside, CT (US)

( * ) Notice: Subject to any disclaimer, the term of this patent is extended or adjusted under 35 U.S.C. 154(b) by 0 days.

(21) Appl. No.: 15/213,121

(22) Filed: Jul. 18, 2016

Related U.S. Application Data

(60) Provisional application No. 62/347,699, filed on Jun. 9, 2016.

(51) Int. Cl.

| | |
|---|---|
| ***B65D 23/12*** | (2006.01) |
| ***B65D 25/20*** | (2006.01) |
| ***B29C 65/48*** | (2006.01) |
| *B29L 31/00* | (2006.01) |
| *B29L 31/10* | (2006.01) |
| *B65D 5/52* | (2006.01) |

(52) U.S. Cl.
CPC ..... *B65D 25/205* (2013.01); *B29C 65/48* (2013.01); *B29L 2031/108* (2013.01); *B29L 2031/712* (2013.01); *B65D 5/528* (2013.01)

(58) Field of Classification Search
CPC . B65D 25/205; B65D 5/528; B29L 2031/712; B29L 2031/108; B29C 65/48
USPC ..... 206/321–324, 730–735, 459.5
See application file for complete search history.

(56) References Cited

U.S. PATENT DOCUMENTS

| | | | | |
|---|---|---|---|---|
| 296,155 | A * | 4/1884 | Fish | A44B 7/00 206/348 |
| 2,322,057 | A * | 6/1943 | Poutinen | G09F 5/04 206/348 |
| 4,807,746 | A * | 2/1989 | Jacobs | C10C 3/12 126/343.5 A |
| 5,183,152 | A * | 2/1993 | Zak | B65D 65/42 206/447 |
| 5,725,122 | A * | 3/1998 | Murphy | B65D 43/0212 206/508 |
| 5,733,616 | A * | 3/1998 | Janicki | B65B 63/08 206/447 |

(Continued)

FOREIGN PATENT DOCUMENTS

EP 0 986 996 A2 * 3/2000

*Primary Examiner* — Luan K Bui
(74) *Attorney, Agent, or Firm* — McCormick, Paulding & Huber

(57) ABSTRACT

The present invention is generally related to product packaging, and more particularly to a product packaging having an external sample of the product contained within the packaging and a method of making the product packaging. The present invention is directed to exemplary embodiments of a product packaging having an external sample of the product contained within the packaging. The product packaging is configured to provide a representation of the product contained within the packaging in the product's final and/or applied form. The product packaging may include a product sample swatch that is configured to affixation to a product container containing the product represented by the sample swatch in its non-final form. The present invention is also directed to exemplary embodiments of a method for affixing a product sample swatch to a product container containing the product represented by the sample swatch in its non-final form.

4 Claims, 1 Drawing Sheet

(56) References Cited

U.S. PATENT DOCUMENTS

| | | | | | |
|---|---|---|---|---|---|
| 5,765,686 | A * | 6/1998 | Wright | B65D 1/22 | 206/447 |
| 5,813,538 | A * | 9/1998 | Kaufman | B65D 85/18 | 206/278 |
| 5,992,628 | A * | 11/1999 | Vermilion | B65D 1/22 | 206/447 |
| 6,095,326 | A * | 8/2000 | Madhat | B65D 83/0805 | 206/233 |
| 7,172,073 | B2 * | 2/2007 | Hanson | B65D 5/4216 | 206/440 |
| 8,017,681 | B2 * | 9/2011 | Guymon | B65D 21/0223 | 206/524.7 |
| 9,327,888 | B2 * | 5/2016 | Knobloch | B65D 71/063 | |
| 2001/0035368 | A1 * | 11/2001 | Carr | B65D 73/0028 | 206/730 |
| 2003/0102238 | A1 * | 6/2003 | White | A61F 15/001 | 206/438 |
| 2007/0029215 | A1 * | 2/2007 | Martinez | E04F 21/00 | 206/223 |
| 2008/0041755 | A1 * | 2/2008 | Noschang | B65D 71/063 | 206/494 |
| 2014/0248082 | A1 * | 9/2014 | Findley | E01C 11/005 | 404/79 |

* cited by examiner

PRODUCT PACKAGING WITH EXTERNAL PRODUCT INDICATOR

CROSS-REFERENCE TO RELATED APPLICATION

This application claims priority to U.S. Provisional Appl. No. 62/347,699 filed Jun. 9, 2016, which is hereby incorporated by reference in its entirety.

BACKGROUND OF THE INVENTION

1. Field of the Invention

The present invention is generally related to product packaging, and more particularly to a product packaging having an external sample of the product contained within the packaging and a method of making the same.

2. Discussion of Related Art

Many mechanisms are used in order to inform and/or guide purchasers of products. For example, trademarks, logos, slogans and other identifying information can be used to convey the source, quality and/or type of a product to a purchaser. Likewise, the packaging for the product itself may have information related to the product, such as a description of the product or intended uses of the product. Often times, the amount of information that can be conveyed to a purchaser are limited by the type of product. For example, it is problematic to convey information about products that are sold to the purchaser in one form that transition to a different form after use and/or application by the purchaser. With such products, it may be difficult to convey adequate information about the final form of such products through the use of conventional product packaging techniques.

Therefore, what is needed is a packaging for a product that provides information regarding the product in its final form to allow a potential purchaser to receive such information regarding the final form of the product and/or evaluate the final form of the product.

SUMMARY OF THE INVENTION

The present invention contemplates the provision of a novel product packaging having an external sample of the product contained within the packaging.

It is an object of the present invention to provide a product packaging that provides a representation of the product contained within the packaging in the product's final and/or applied form.

It is another object of the present invention to provide a product sample swatch that is configured to affixation to a product container containing the product represented by the sample swatch in its non-final form.

It is still another object of the present invention to provide a method of affixing a product sample swatch to a product container containing the product represented by the sample swatch in its non-final form.

According to an exemplary embodiment of the present invention a product packaging is provided that may include a container configured to hold a first form of a product in an internal space thereof, and a swatch comprising the product in a second form applied to an external surface of the container.

According to this or other exemplary embodiments of the present invention, the second form of the product may be a representation of a final form of the product when the product is used for an intended use of the product.

According to this or other exemplary embodiments of the present invention, the final form of the product may be a dried, hardened or cured state of the product.

According to this or other exemplary embodiments of the present invention, the first form of the product may be a liquid or uncured state of the product.

According to this or other exemplary embodiments of the present invention, the swatch of the product may have a predetermined size and shape.

According to this or other exemplary embodiments of the present invention, the swatch of the product may provide at least one indicia regarding the color, texture or hardness of the final form of the product.

According to this or other exemplary embodiments of the present invention, the product may be for application to roofs and/or driveways.

According to this or other exemplary embodiments of the present invention, the product may be an acrylic, silicone and/or asphalt based product.

According to this or other exemplary embodiments of the present invention, the swatch may include an adhesive layer positioned between the product and the container, and a primer layer positioned between the adhesive layer and the product.

According to this or other exemplary embodiments of the present invention, the primer layer may include an acrylic polymer.

According to this or other exemplary embodiments of the present invention, the first form of product positioned within the internal space of the container may be a liquid state, and the second form of the product on the swatch may be a dried state.

According to another exemplary embodiment of the present invention, a method is provided for producing a product packaging having at least one indicia of a product configured for containment within the product packaging that may include applying the product in a first form to a substrate adhesive, drying, hardening or curing the product into a second form, creating a swatch of a predetermined size and shape of the second form of the product and substrate adhesive, and applying the swatch to an external surface of the product packaging.

According to this or other exemplary embodiments of the present invention, the method may also include applying a primer to the substrate adhesive, and allowing the primer to dry before applying the product in the first form to the substrate adhesive.

According to this or other exemplary embodiments of the present invention, the primer may be applied between the substrate adhesive and the product in the first form.

According to this or other exemplary embodiments of the present invention, the primer may be configured to increase the adhesion of the product in the first form and in the second form to the substrate adhesive.

According to this or other exemplary embodiments of the present invention, the method may also include inserting the product in the first form into an internal space of the product packaging.

According to this or other exemplary embodiments of the present invention, the product may be for application to roofs and/or driveways.

According to this or other exemplary embodiments of the present invention, the product may be an acrylic, silicone and/or asphalt based product.

According to this or other exemplary embodiments of the present invention, the second form of the product may be a dried, hardened or cured state of the product.

According to this or other exemplary embodiments of the present invention, the first form of the product may be a liquid or uncured state of the product.

BRIEF DESCRIPTION OF THE SEVERAL VIEWS OF THE DRAWINGS

For a fuller understanding of the nature and object of the present invention, reference should be had to the following detailed description taken in connection with the accompanying drawings, in which.

DETAILED DESCRIPTION OF THE INVENTION

Figure 1:
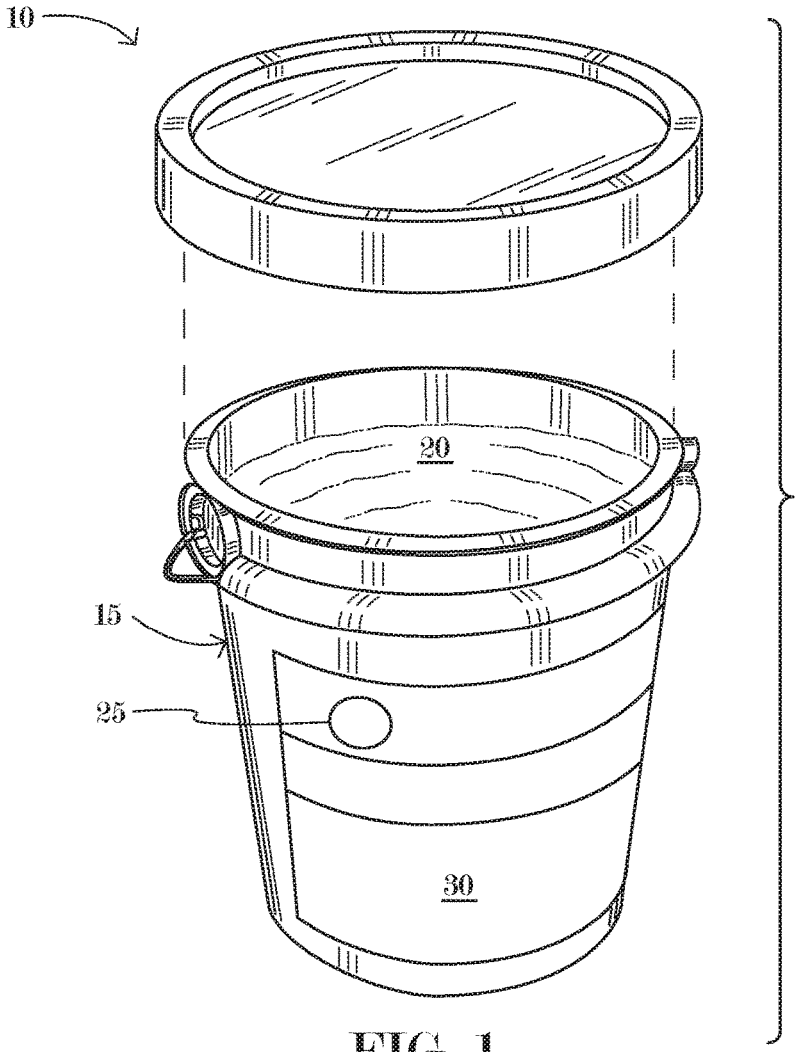
FIG. 1 is a perspective view of an exemplary embodiment of product packaging having an external product indicator according to the present invention.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Referring now to FIG. 1, therein illustrated is an exemplary product packaging, generally indicated by reference numeral 10, according to an exemplary embodiment of the present invention. The product packaging 10 according to the present invention may include a container 15 in which a product 20 may be placed therein. It is understood that the term container is merely exemplary and not limiting, and the container may have any form or configuration capable of holding product, and may include, but not be limited to a carton, box, packet, pail, jar, bucket, can, bag or the like in which the product 20 may be placed therein. The product 20 may be any raw, intermediate or finished product. For example, the product 20 may be a liquid coating for application to roofs and/or driveways, and may have an acrylic, silicone and/or asphalt base. Preferably, the product 20 is in one state while within the container 15, but after application and/or use of the product 20 for its intended purpose the product 20 is configured to transition to another state. For example, the product 20 may be in a liquid state, and after application of the product 20 to a surface the product 20 dries, hardens, cures or otherwise solidifies into a solid state or substantially solid state. It is understood that for the purposes of this disclosure a substantially solid state includes, but is not limited to, a liquid state that perceptively is viewed under ambient conditions as a solid. Alternatively, the product 20 may be in a solid state or substantially solid state within the container 15, for example in a granular or powder form, and through the application of an external liquid or heat the product 20 may be made into a liquid form, and then returned to a solid or substantially solid state as the result of drying, hardening, cooling and/or curing. For example, the product 20 may be a solid that melts as a result of the application of heat to the solid, or the product 20 may be a grout or other type of concrete that transitions to a substantially liquid form after the application of a liquid, such as water. It is understood that the product 20 may also include slurries, homogenous or heterogeneous solutions or any other product forms. It is also understood that the product 20 may be configured for drying, hardening, curing or otherwise solidifying through mechanical, chemical or ultraviolet means or the application of heat.

Still referring to FIG. 1, the product packaging 10 may include a swatch 25 of the product 20 in its solid or substantially solid state on an exterior surface of the product packaging 10. The swatch 25 may be applied directly to the product packaging 10 or may be applied to a label 30 or other wrapping on the exterior surface of the product packaging 30. The swatch 25 is a representation of the product 20 from the container in the product's 20 dried, hardened and/or cured form. For the purposes of this disclosure, it is understood that the product's 20 dried, hardened and/or cured form is a representation of the final form of the product 20, as a result of application of the product 20 to a desired surface and/or substrate. For example, and merely for the purposes of illustration, if the product 20 was a glue, then the final form of the glue would be considered to be dried and/or cured form of the glue. In this manner, the swatch 25 provides an example or indicia of the final form of the product 20 from the container 15 having the swatch 25 therein that is obtained after the product 20 has been applied for its desired application. The swatch 25 can be used to provide an accurate representation of the color, texture, quality, hardness and/or durability of the product in its dried, hardened and/or cured form. The swatch 25 allows a potential purchaser of the product 20 to evaluate the product 20 without requiring the potential purchaser to obtain a sample of the product 20, apply the product 20 to a surface and/or substrate associated with the desired application of the product, and to wait for the product 20 to dry, harden and/or cure. Furthermore, since the product 20 may have an entirely different consistency and/or be in an entirely different state from its dried, hardened and/or cured form, it is not necessarily possible for the potential purchaser to fully evaluate the product 20, even if the potential purchaser was able to access the product 20 within the container 15. Therefore, the swatch 25 located on the container 15 overcomes this problem.

Figure 2:
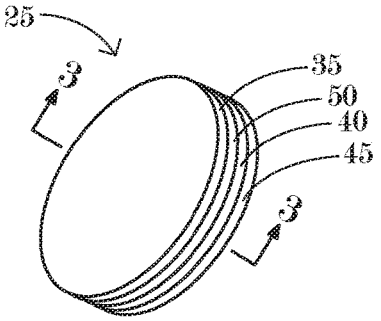
FIG. 2 is a perspective view of an exemplary embodiment of a product indicator according to the present invention.
Figure 3:
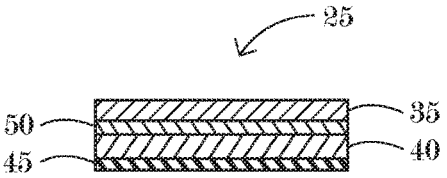
FIG. 3 is a cross-sectional view of the exemplary product indicator taken along line 3-3 from FIG. 2.

Referring now to FIGS. 2 and 3, the exemplary swatch 25 according to the present invention is shown in greater detail. It is understood that the swatch 25 may have any predetermined desired size and/or shape, and that while a substantially circular swatch 25 is shown it is understood that this is merely exemplary. Accordingly, the swatch may have any size, shape or configuration, and may for example be triangular, square, rectangular or polygonal. The swatch 25 may include multiple layers, and may include a product layer 35 of the product 20 in its dried, hardened and/or cured form. The swatch 25 may also include an adhesive layer 40 that is configured to adhere the product layer 35 to the container 15. Alternatively, the product layer 35 may be put directly on the container 15 without the need for an intermediate adhesive layer 40, for example, the product 20 may be applied directly to the container 15 and allowed to dry, harden and/or cure. The adhesive layer 40 may be any suitable adhesive substance or tape, and may preferably be a 100% solid adhesive tape having a 30 mil thickness, and comprised of synthetic resin, thermoplastics, non-curing rubber, double coated/impregnated latex primer and/or woven polyester backing. The adhesive layer 40 may include a release liner 45, for example a silicone release liner that prevents the adhesive layer 40 from sticking to surfaces other than the desired application surface, which according to an exemplary embodiment of the present invention is the container 15. The release liner 45 may also be made from polyethylene or any other suitable material that does not readily adhere to the adhesive layer 40. Preferably, the adhesive layer 40 may have an adhesion of 19 lbs. per inch, excellent flexibility at low temperatures, an operational range of −70° F. to 200° F., results of 0.005 grams/100", sq./24 hours/100° F. for the ASTME 96B water vapor test, permanence of 0.001 maximum, elongation of greater than 500% and an application temperature between 150° and 20° F. The swatch 25 may also include an adherence layer 50 positioned between the product layer 35 and the adhesive layer 40 that facilities binding of the product layer 35 to the adhesive layer 40. For example, the adherence layer 50 may be a 100% acrylic polymer that is configured to bind to both the adhesive layer 40 and the product layer 35. The adherence layer 50 may act as a primer for the adhesive layer 40 in order to prepare the adhesive layer 40 for binding with the product layer 35.

The method of manufacturing the product packaging 10 according to an exemplary embodiment of the present invention will now be discussed. An adhesive tape that may or may not include a release liner is coated on its non-adhesive side with a primer, for example an acrylic polymer. Once the primer is sufficiently dry, for example after a period of 24 hours, the product 20 is applied to the adhesive tape on the dried primer. The product 20 may be applied to the adhesive tape in the desired thickness according to the particular application for the product 20. The adhesive tape with the product 20 applied is allowed to dry, harden and/or cure in a controlled environment, which is preferably free of dust and debris. Once the product 20 has dried, hardened and/or cured, a custom tooled punch may be used to cut the adhesive tape with the product 20 applied to the desired size and shape for the swatch 25. In this manner, the swatch 25 may be provided with the layer discussed above with respect to FIGS. 2 and 3. Once the swatch 25 has been cut to the desired size and shape, the swatch 25 is adhered to the container 15 through the use of the adhesive layer 40 in order to create the product packing 10 according to the present invention. It is understood that the swatch 25 may have any predetermined desired size and/or shape, and that while a substantially circular swatch 25 is shown it is understood that this is merely exemplary. Accordingly, the swatch may have any size, shape or configuration, and may for example be triangular, square, rectangular or polygonal.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense. It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A packaged product for application to roof or driveway surfaces, comprising:

a container comprising an internal space and an external surface;

a roofing or driveway coating product in a liquid state disposed in the internal space of the container, the roofing or driveway coating product comprising an acrylic, silicone and/or asphalt, the roofing or driveway coating product being adapted to dry, harden, cure or otherwise solidify from the liquid state into a solid state or substantially solid state; and a swatch of the roofing or driveway coating product in the solid state or substantially solid state being applied to the external surface of the container;

wherein the swatch of the roofing or driveway coating product is a representation of a final form of the roofing or driveway coating product when the roofing or driveway coating product is applied to a roof or driveway; and wherein the swatch comprises a substrate on which the roofing or driveway coating product is disposed, an adhesive layer on the substrate for adhering the swatch to the external surface of the container, and a primer layer on the substrate positioned between the substrate and the roofing or driveway coating product.

2. The packaged product according to claim 1, wherein the swatch of the roofing or driveway coating product has a predetermined size and shape.

3. The packaged product according to claim 1, wherein the swatch of the product provides at least one indicia regarding the color, texture or hardness of the roofing or driveway coating product in the solid state or substantially solid state.

4. The packaged product according to claim 1, wherein the primer layer comprises an acrylic polymer.

* * * * *